US009127520B2

(12) United States Patent
Steele

(10) Patent No.: US 9,127,520 B2
(45) Date of Patent: Sep. 8, 2015

(54) APPARATUS, SYSTEM AND METHOD FOR CIRCUMFERENTIALLY ORIENTING A DOWNHOLE LATCH SUBSYSTEM

(71) Applicant: Halliburton Energy Services, Inc., Houston, TX (US)

(72) Inventor: David Joe Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/953,018

(22) Filed: Jul. 29, 2013

(65) Prior Publication Data

US 2014/0144652 A1 May 29, 2014

(51) Int. Cl.
*E21B 23/03* (2006.01)

(52) U.S. Cl.
CPC ..... *E21B 23/03* (2013.01)

(58) Field of Classification Search
CPC ..... E21B 7/06; E21B 7/061; E21B 23/02; E21B 29/06; E21B 23/03
USPC ..... 166/378, 380, 381, 117.5, 117.6, 242.5
See application file for complete search history.

(56) References Cited

U.S. PATENT DOCUMENTS

| | | | | |
|---|---|---|---|---|
| 5,579,829 | A | 12/1996 | Comeau et al. | |
| 5,871,046 | A | 2/1999 | Robison | |
| 6,012,527 | A * | 1/2000 | Nitis et al. | 166/313 |
| 6,041,855 | A | 3/2000 | Nistor | |
| 6,202,746 | B1 | 3/2001 | Vandenberg | |
| 6,206,111 | B1 | 3/2001 | Nistor | |
| 6,244,340 | B1 | 6/2001 | McGlothen et al. | |
| 6,283,208 | B1 * | 9/2001 | George et al. | 166/255.3 |
| 6,935,428 | B2 | 8/2005 | McGlothen et al. | |
| 7,207,390 | B1 | 4/2007 | Pratt | |
| 2004/0149430 | A1 * | 8/2004 | Campbell et al. | 166/216 |
| 2011/0186291 | A1 | 8/2011 | Loc et al. | |
| 2012/0103687 | A1 | 5/2012 | Saurer | |

OTHER PUBLICATIONS

International Search Report and Written Opinion; PCT/US2012/066951, KIPO, Jul. 18, 2013.

* cited by examiner

*Primary Examiner* — Elizabeth Gitlin

(57) ABSTRACT

A downhole latch assembly has a plurality of latch keys including a primary latch key. A window joint is interconnected in a casing string positioned in a wellbore. A latch coupling having a latch profile is interconnected in the casing string downhole of the window joint. An orienting subassembly interconnected in the casing string has an orienting profile positioned uphole of the latch profile such that after operable engagement of the primary latch key with the orienting profile, axial alignment of the latch assembly with the latch coupling causes operable engagement of the latch keys with the latch profile.

24 Claims, 6 Drawing Sheets

28
10
26
12
20
18
22
16
24
30
32
34
36
44
42
46
40
38
14

APPARATUS, SYSTEM AND METHOD FOR CIRCUMFERENTIALLY ORIENTING A DOWNHOLE LATCH SUBSYSTEM

CROSS-REFERENCE TO RELATED APPLICATIONS

This application claims the benefit under 35 U.S.C. §119 of the filing date of International Application No. PCT/US2012/066951, filed Nov. 29, 2012.

TECHNICAL FIELD OF THE INVENTION

This invention relates, in general, to equipment utilized in conjunction with operations performed in relation to subterranean wells and, in particular, to an apparatus, system and method for circumferentially orienting a latch assembly relative to a latch coupling in a subterranean well.

BACKGROUND OF THE INVENTION

Without limiting the scope of the present invention, its background will be described in relation to forming a window in a casing string during multilateral wellbore construction, as an example.

In multilateral wellbore construction, it is common practice to drill a branch or lateral wellbore extending outwardly from an intersection with a main or parent wellbore. Typically, once the casing string is installed and the parent wellbore has been completed, a deflection assembly such as a whipstock is positioned in the casing string at the desired intersection and then one or more rotating mills are deflected laterally off the whipstock to form a window through the casing sidewall.

In certain installations, it is desirable to drill the lateral wellbore in a predetermined direction from the parent wellbore such as out of the high side of the parent wellbore. In such installations, it is necessary to form the window at a predetermined circumferential orientation relative to the parent casing. In order to properly position and rotationally orient the whipstock such that the window is milled in the desired direction, a latch assembly associated with the whipstock is anchored into and rotationally oriented within a latch coupling interconnected in the casing string. The latch assembly typically includes a plurality of spring operated latch keys, each of which having an anchoring and orienting profile that is received in a latch profile formed internally within the latch coupling. In this manner, when the latch keys of the latch assembly are operatively engaged with the latch profile of the latch coupling, the latch assembly and the equipment associate therewith are axially and circumferentially anchored and rotationally oriented in the desired direction within the casing string.

It has been found, however, that in certain well installations such as deep or extended reach wells, rotationally securing a latch assembly within a latch coupling may be difficult. In typically practice, once the latch assembly is substantially on depth, the tool string carrying the latch assembly is slowly rotated and lowered into the well. This operation is intended to axially position the latch assembly in the latch coupling and rotationally align the latch assembly in the latch coupling in the desired circumferential orientation as indicated by a torque signal at the surface. In the aforementioned deep or extended reach wells, however, delay in the torque signal reaching the surface due to torsional flexibility and wind up of the worksting, for example, may result in over stressing the latch keys, release of the latch assembly from the latch coupling or other failure.

Accordingly, a need has arisen for an improved system for circumferentially orienting a downhole latch subsystem in a subterranean well. In addition, a need has arisen for such an improved system that is operable for use in deep or extended reach wells. Further, a need has arisen for such an improved system that does not risk over stressing the latch keys or releasing the latch assembly from the latch coupling during circumferential orientation.

SUMMARY OF THE INVENTION

The present invention disclosed herein is directed to a system for circumferentially orienting a downhole latch subsystem in a subterranean well. The system of the present invention is operable for use in deep and extended reach wells. In addition, the system of the present invention does not risk over stressing the latch keys or releasing the latch assembly from the latch coupling during circumferential orientation.

In one aspect, the present invention is directed to an apparatus for circumferentially orienting a downhole latch assembly in a wellbore. The downhole latch assembly has a plurality of latch keys including a primary latch key. The apparatus includes a casing string positionable in the wellbore. A window joint is interconnected in the casing string. A latch coupling is interconnected in the casing string downhole of the window joint. The latch coupling has a latch profile. An orienting subassembly is interconnected in the casing string. The orienting subassembly has an orienting profile positioned uphole of the latch profile such that after operable engagement of the primary latch key with the orienting profile, axial alignment of the latch assembly with the latch coupling causes operable engagement of the latch keys with the latch profile.

In one embodiment, the orienting subassembly is integral with the window joint. In another embodiment, the orienting subassembly is integral with the latch coupling. In a further embodiment, a first portion of the orienting subassembly is integral with the window joint and a second portion of the orienting subassembly is integral with the latch coupling. In some embodiments, the orienting subassembly may be an axial slot extending downhole from a window of the window joint. In other embodiments, the orienting subassembly may be at least one axially extending slot in the latch coupling. In certain embodiments, the orienting subassembly may be at least two axially extending rails having a channel therebetween in the latch coupling. In this embodiment, each of the rails may have a tapered leading edge.

In another aspect, the present invention is directed to a system for circumferentially orienting a downhole latch subsystem in a wellbore. The system includes an outer tool assembly including a latch coupling having a latch profile and an orienting subassembly having an orienting profile positioned proximate to the latch profile. An inner tool assembly positionable within the outer tool assembly includes a latch assembly having a plurality of latch keys including a primary latch key such that after operable engagement of the primary latch key with the orienting profile, axial alignment of the latch assembly with the latch coupling causes operable engagement of the latch keys with the latch profile.

In one embodiment, at least a portion of the orienting subassembly is positioned uphole of the latch profile. In another embodiment, at least a portion of the orienting subassembly is positioned downhole of the latch profile. In one embodiment, the inner tool assembly may include a retention subassembly having at least one retention key such that after operable engagement of the primary latch key with the orienting profile, axial shifting of the latch assembly toward the latch coupling causes operable engagement of the retention key with the orienting profile before disengagement of the primary latch key from the orienting profile. In another embodiment, the inner tool assembly may include a retention subassembly having at least one retention key such that after operable engagement of the primary latch key with a first portion of the orienting profile, axial shifting of the latch assembly toward the latch coupling causes operable engagement of the retention key with the first portion of the orienting profile before disengagement of the primary latch key from the first portion of the orienting profile.

In a further aspect, the present invention is directed to a method for circumferentially orienting a downhole latch subsystem in a wellbore. The method includes positioning a casing string in the wellbore, the casing string including a latch coupling having a latch profile and an orienting subassembly having an orienting profile proximate to the latch profile; running a tool string into the casing string, the tool string including a latch assembly having a plurality of latch keys including a primary latch key; positioning the latch assembly uphole of the orienting subassembly; rotating the tool string to coarsely orient the primary latch key with the orienting profile; axially shifting of the latch assembly toward the latch coupling; operably engaging the primary latch key with the orienting profile; and axially aligning the latch assembly with the latch coupling, thereby operably engaging the latch keys with the latch profile.

The method may also include operably engaging the primary latch key with an axial slot extending downhole from a window of a window joint interconnected in the casing string, operably engaging the primary latch key with an axially extending slot of the latch coupling, operably engaging the primary latch key with an axially extending channel of the latch coupling, operably engaging a retention key of a retention subassembly of the tool string with the orienting profile after operably engaging the primary latch key with the orienting profile and before disengaging the primary latch key from the orienting profile and/or orienting the primary latch key based upon at least one measured property of the wellbore.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
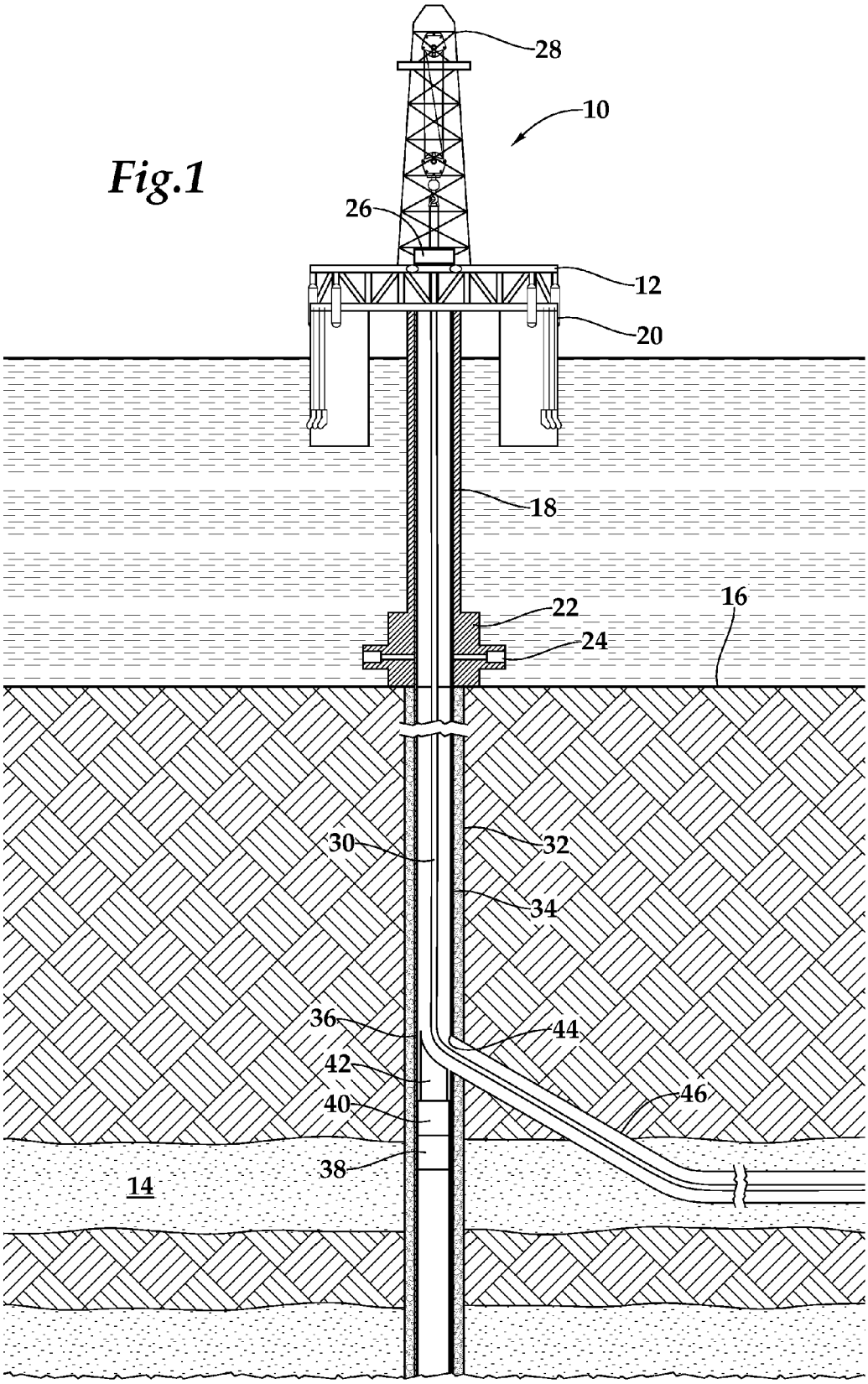
FIG. 1 is a schematic illustration of an offshore platform during multilateral wellbore construction following the operation of a system for circumferentially orienting a downhole latch subsystem in a subterranean well according to an embodiment of the present invention.

Referring to FIG. 1, a system for circumferentially orienting a downhole latch subsystem in a subterranean well is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings such as drill string 30. A main wellbore 32 has been drilled through the various earth strata including formation 14. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. A casing string 34 is cemented within main wellbore 32. The term "casing" is used herein to designate a tubular string used in a wellbore or to line a wellbore. The casing may be of the type known to those skilled in the art as a "liner" and may be made of any material, such as steel or a composite material and may be segmented or continuous, such as coiled tubing.

Casing string 34 includes a window joint 36 interconnected therein. In addition, casing string 34 includes a latch coupling 38 and an orienting subassembly 40. Latch coupling 38 has a latch profile that is operably engagable with latch keys of a latch assembly (not visible in FIG. 1) such that the latch assembly may be axially anchored and rotationally oriented in latch coupling 38. Orienting subassembly 40 has an orienting profile that is operably engagable with the primary latch key of the latch assembly and in some embodiments, a retention key of a retention subassembly (not visible in FIG. 1). Using the system for circumferentially orienting a downhole latch subsystem of the present invention, when the latch assembly is deployed downhole, it is rotated such that the primary latch key operably engages the orienting profile of orienting subassembly 40. This operation orients the latch keys of the latch assembly with the latch profile of latch coupling 38 such that axial shifting of the latch assembly into latch coupling 38 operably engages the latch keys of the latch assembly with the latch profile of latch coupling 38 without rotation of the latch assembly within latch coupling 38.

In the illustrated embodiment, when the primary latch key of the latch assembly has operably engaged the orienting profile of orienting subassembly 40 and the latch keys of the latch assembly have thereafter operably engaged the latch profile of latch coupling 38, a deflection assembly depicted as whipstock 42 is positioned in a desired circumferential orientation relative to window joint 36 such that a window 44 can be milled, drilled or otherwise formed in window joint 36 in the desired circumferential direction. As illustrated, window joint 36 is positioned at a desired intersection between main wellbore 32 and a branch or lateral wellbore 46. The terms "branch" and "lateral" wellbore are used herein to designate a wellbore that is drilled outwardly from its intersection with another wellbore, such as a parent or main wellbore. A branch or lateral wellbore may have another branch or lateral wellbore drilled outwardly therefrom.

Even though FIG. 1 depicts the system for circumferentially orienting a downhole latch subsystem of the present invention in a vertical section of a main wellbore, it should be understood by those skilled in the art that the system of the present invention is equally well suited for use in wellbores having other directional configurations including horizontal wellbores, deviated wellbores, slanted wells, lateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Also, even though the system for circumferentially orienting a downhole latch subsystem of the present invention is depicted in a main wellbore having a single lateral wellbore extending therefrom, it should be understood by those skilled in the art that the system of the present invention can be used in main wellbores having multiple lateral wellbores each of which may utilize a system of the present invention for positioning and orienting a deflection assembly as each system of the present invention has a non restrictive inner diameter that enables non mating or non aligned latch assemblies to pass through a latch coupling.

Figure 2A:
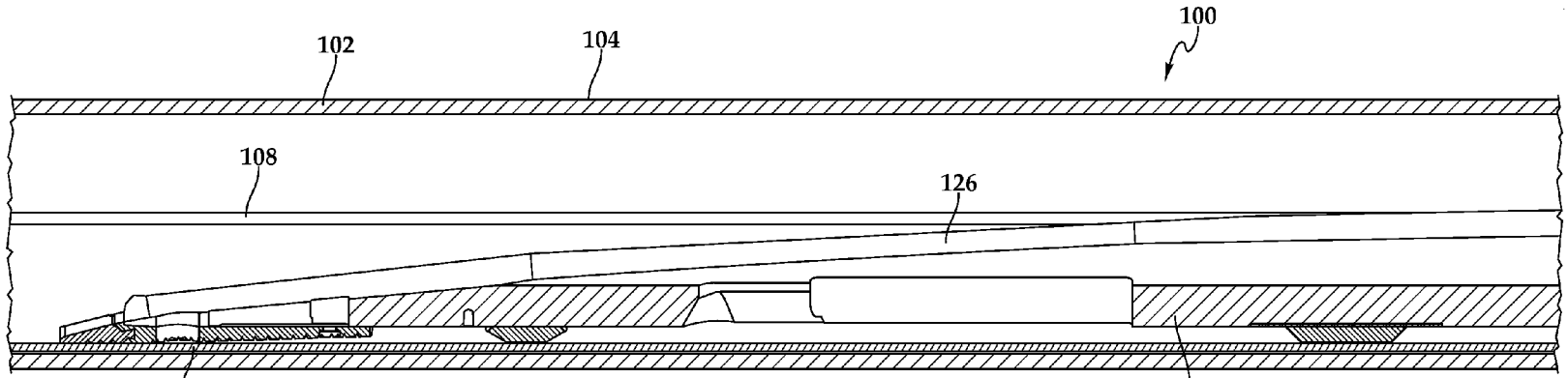
FIGS. 2A-2F are cross sectional views of consecutive axial sections of a system for circumferentially orienting a downhole latch subsystem in a subterranean well according to an embodiment of the present invention.
Figure 2B:
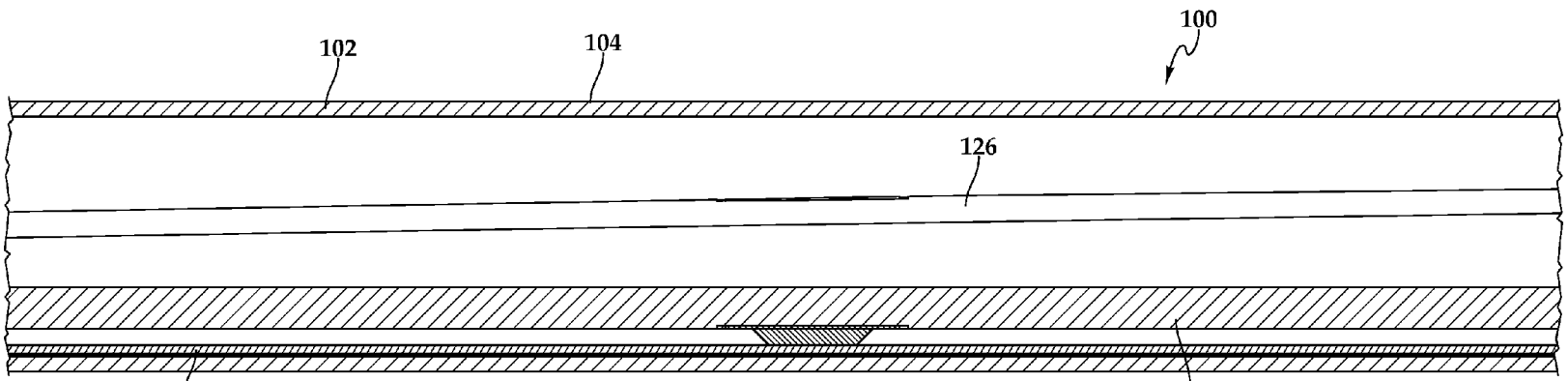
Figure 2C:
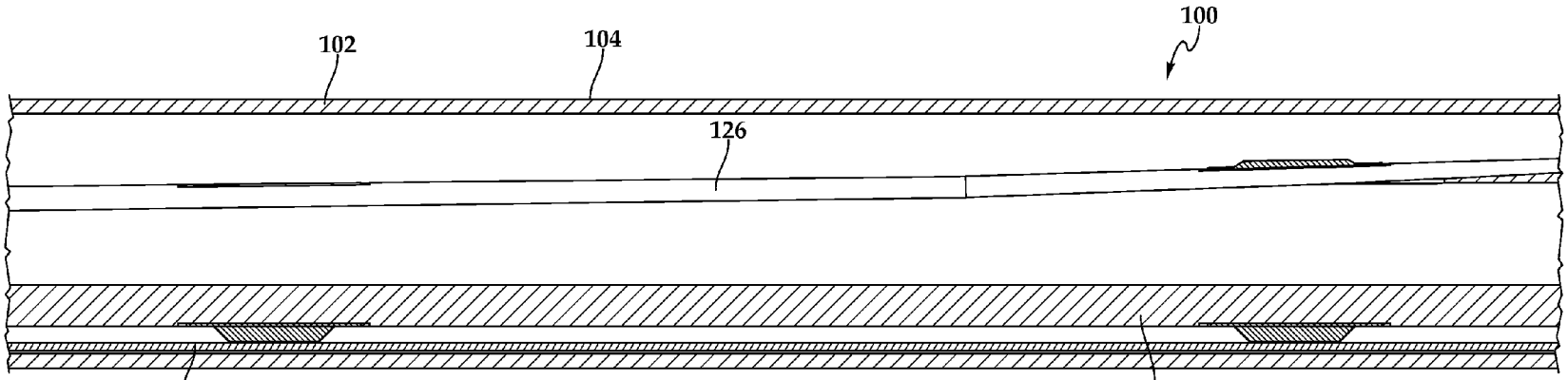
Figure 2D:
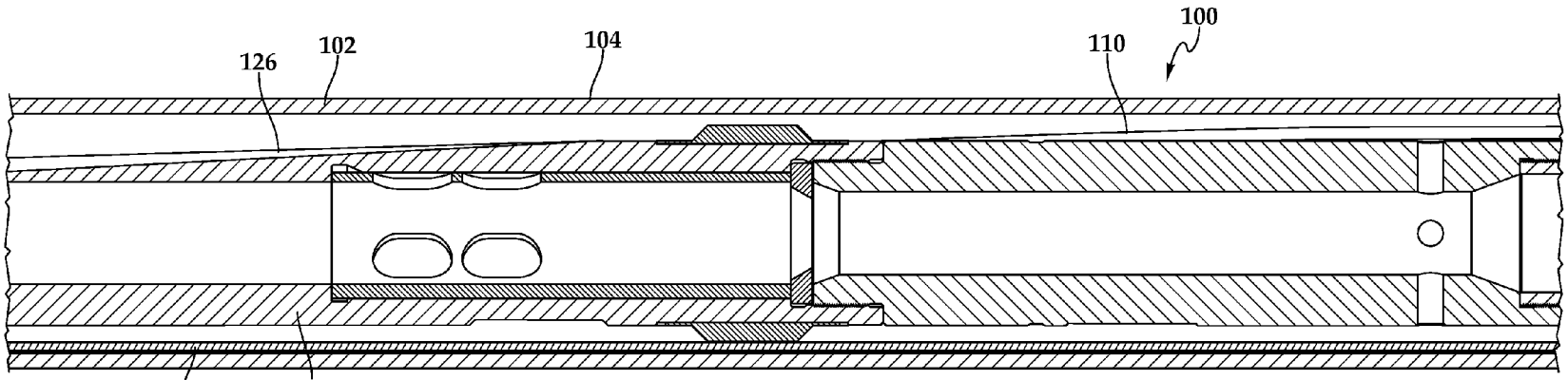
Figure 2E:
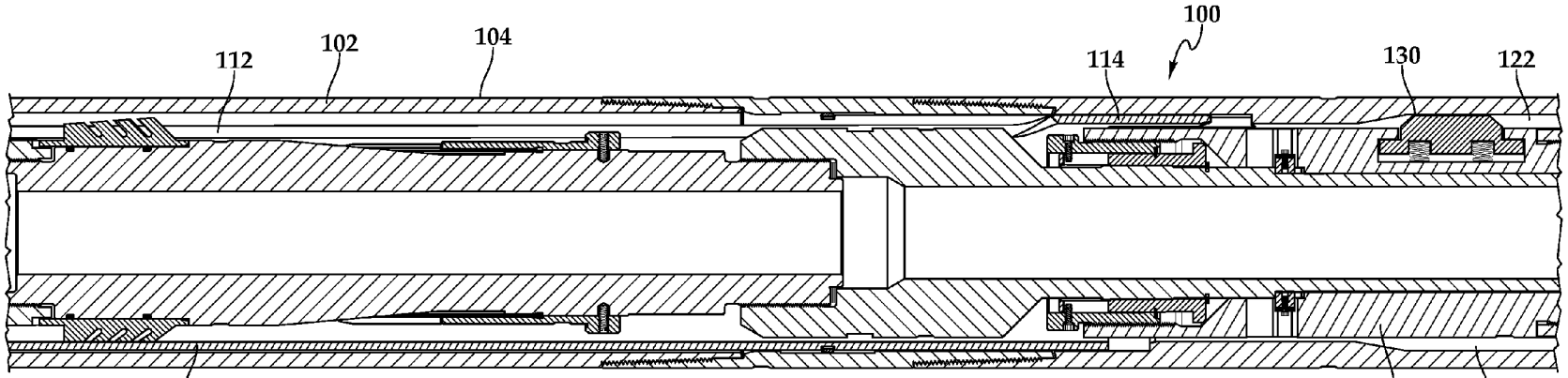

Referring now to FIG. 2, a system for circumferentially orienting a downhole latch subsystem is depicted and generally designated 100. In the illustrated embodiment, a portion of system 100 is constructed as part of casing string 102. Casing string 102 includes a window joint 104 that is preferably formed from an easily millable or drillable material such as aluminum. Even though window joint 104 has been described as being formed from an easily millable or drillable material, those skilled in the art will understand that window joint 104 could alternatively be formed from standard casing or could have a pre-milled window formed therein. As illustrated, window joint 104 has a window sleeve 106 positioned therein. Preferably, window sleeve 106 is formed from a durable material such as steel. As best seen in FIG. 3, window sleeve 106 has a precut window 108, a tapered section 110 and an axially extending slot 112. As described in greater detail below, axially extending slot 112 may be considered to be an orienting profile of an orienting subassembly integral with window sleeve 106 of window joint 104. Alternatively, axially extending slot 112 may be considered to be a first portion of a two part orienting profile of an orienting subassembly, the first portion of which is integral with window sleeve 106 of window joint 104, the second portion being integral with a latch coupling disposed downhole thereof. It should be understood by those skilled in the art that a window sleeve and/or window joint of the present invention could alternatively contain no portion of the orienting profile of an orienting subassembly, wherein the entire orienting subassembly is positioned downhole of the window joint. At its lower end, window sleeve 106 has a castellated coupling 114.

Figure 2F:
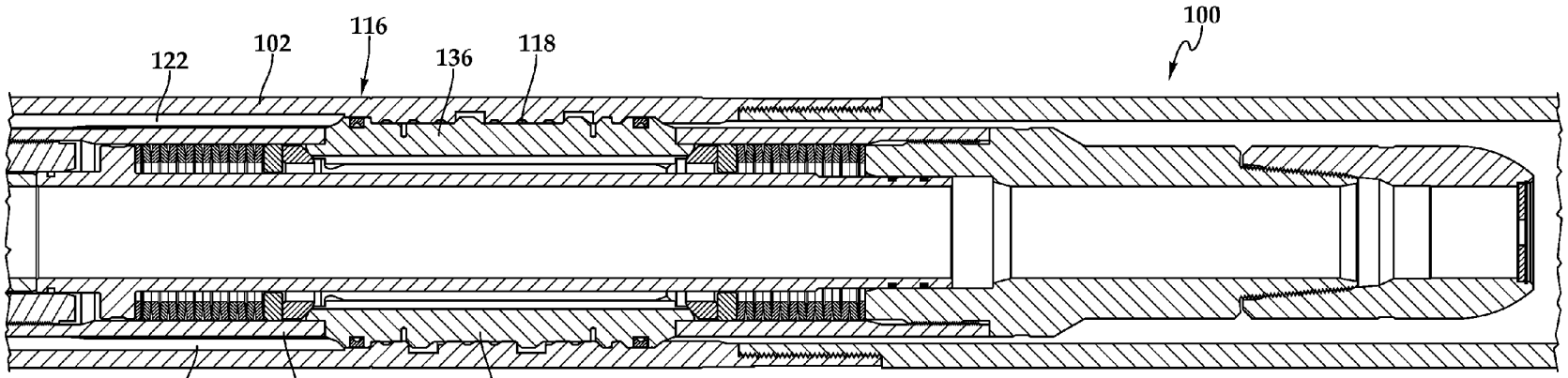
Figure 3:
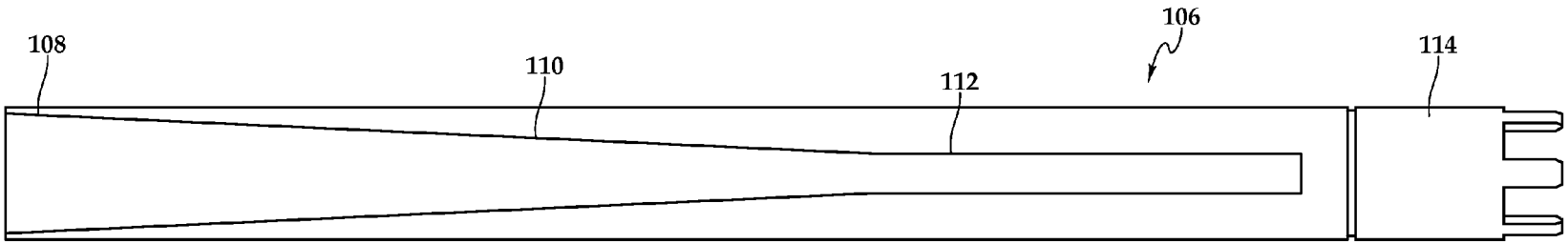
FIG. 3 is a top view of a window sleeve for use in a system for circumferentially orienting a downhole latch subsystem in a subterranean well according to an embodiment of the present invention

As best seen in FIG. 2F, casing string 102 includes a latch coupling 116 having a latch profile 118. As explained in further detail below, latch profile 118 preferably includes a plurality of circumferential alignment elements that are operable to receive latch keys of a latch assembly therein to locate the latch assembly in a particular circumferential orientation and axial position. In the illustrated embodiment, latch coupling 116 has a plurality of axially extending and circumferentially distributed slots 120 including a slot 122 that is circumferentially aligned with slot 112 of window joint 104. As described in greater detail below, slot 122 may be considered to be an orienting profile of an orienting subassembly integral with latch coupling 116. Alternatively, slot 122 may be considered to be a second portion of a two part orienting profile of an orienting subassembly, the first portion of which is integral with window joint 104, the second portion of which is integral with latch coupling 116. Together, latch coupling 116 and an orienting subassembly, along with window joint 104 in some embodiments, may be referred to as an outer tool string that is operable to receive another tool string in the central pathway therethrough.

Disposed within casing string 102 is an inner tool string that is operable to be run into the outer tool string. In the illustrated embodiment, the inner tool string includes a deflection assembly depicted as whipstock 124 having a deflector surface 126 operable to direct a milling or drilling tool through window 108 of window sleeve 106 and into the sidewall of window joint 104 to create a window therethrough. Alternatively, in a completion embodiment, the deflection assembly would be a completion deflector operably to direct the desired completion equipment into the branch wellbore while allowing the desired equipment or fluid to travel in the main wellbore. Positioned downhole of whipstock 124, the inner tool string includes a retention subassembly 128 having a spring operated retention key 130, as best seen in FIG. 2E. Downhole thereof, the inner tool string includes a latch assembly 132 having a plurality of latch keys 134 including a primary latch key 136 that is circumferentially aligned with retention key 130. Latch keys 134 are depicted as being operably engaged with latch profile 118 of latch coupling 116, as best seen in FIG. 2F. In this configuration, when latch keys 134 of latch assembly 132 have operably engaged latch profile 118 of latch coupling 116, deflector surface 126 of whipstock 124 is positioned in the desired circumferential orientation relative to window joint 104 allowing the window to be milled, drilled or otherwise formed in window joint 104 in a drilling embodiment.

Figure 4:
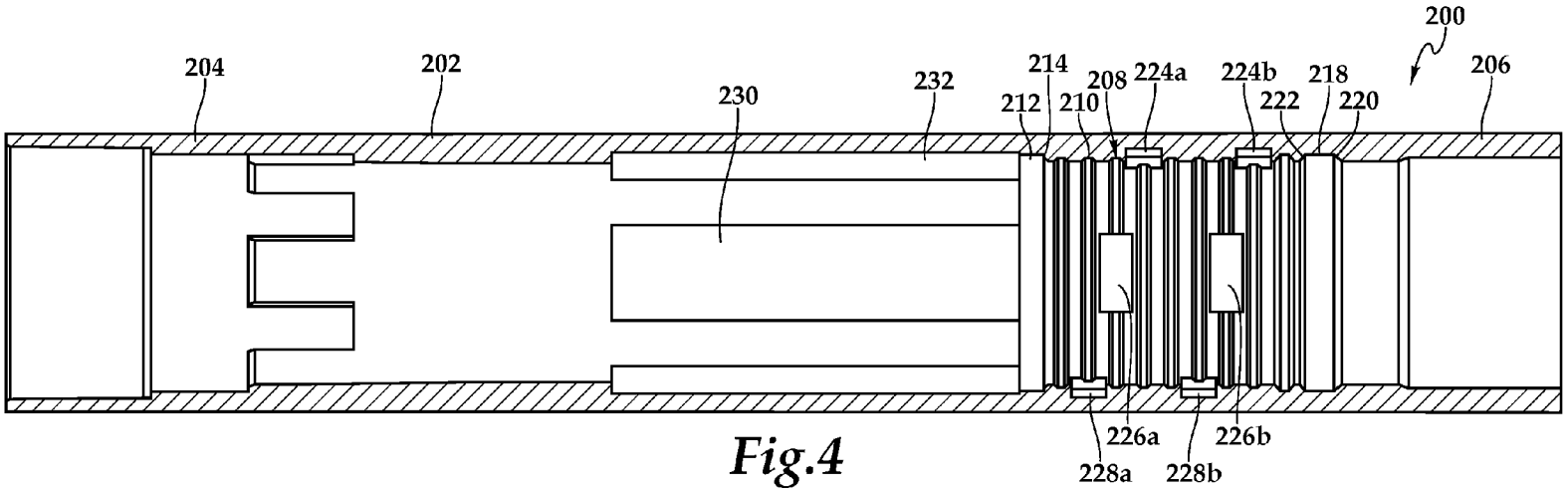
FIG. 4 is a cross sectional view of a latch coupling for use in a system for circumferentially orienting a downhole latch subsystem in a subterranean well according to an embodiment of the present invention.

Referring next to FIG. 4, one embodiment of a latch coupling for use in a system for circumferentially orienting a downhole latch subsystem of the present invention is depicted and generally designated 200. Latch coupling 200 is representative of latch coupling 116 discussed above. It is noted that each latch coupling may have a unique latch profile that is different from the latch profile of another latch coupling. This enables selective engagement with a matching or mating set of latch keys in a desired latch assembly. Accordingly, latch coupling 200 is described herein to illustrate the type of elements and combination of elements that can be used to create any number of unique latch profiles as contemplated by the present invention.

Latch coupling 200 has a generally tubular body 202 having an upper castellated coupling 204 for interconnection with castellated coupling 114 of window sleeve 106. At its lower end, latch coupling 200 has a lower connector 206 suitable for connecting latch coupling 200 to other tools or tubulars via a threaded connection, a pinned connection or the like. Latch coupling 200 includes an internal latch profile 208 including a plurality of axially spaced apart recessed grooves 210 that extend circumferentially about the inner surface of latch coupling 200. Preferably, recessed grooves 210 extend about the entire circumferential internal surface of latch coupling 200. Latch profile 208 also includes an upper groove 212 having a lower square shoulder 214. Latch profile 208 further includes a lower groove 218 having a lower angled shoulder 220 and an upper angled shoulder 222.

Latch profile 208 also has a plurality of circumferential alignment elements depicted as a plurality of recesses disposed within the inner surface of latch coupling 200. In the illustrated embodiment, there are four sets of two recesses that are disposed in different axial and circumferential positions or locations within the inner surface of latch coupling 200. For example, a first set of two recesses 224*a*, 224*b* (collectively recesses 224) are disposed within the inner surface of latch coupling 200 at substantially the same circumferential positions and different axial positions. Recesses 224 may be considered as the primary recesses as they are intended to receive the primary latch key. A second set of two recesses 226*a*, 226*b* (collectively recesses 226) are disposed within the inner surface of latch coupling 200 at substantially the same circumferential positions and different axial positions. A third set of two recesses 228*a*, 228*b* (collectively recesses 228) are disposed within the inner surface of latch coupling 200 at substantially the same circumferential positions and different axial positions. A fourth set of two recesses (not visible in FIG. 4) are also disposed within the inner surface of latch coupling 200 at substantially the same circumferential positions and different axial positions. As illustrated, each set of recesses is disposed within the inner surface of latch coupling 200 at a ninety degree circumferentially interval from the adjacent set of recesses. Also, as illustrated, the recesses only partially extend circumferentially about the internal surface of latch coupling 200.

It is noted that latch profile 208 including the circumferential alignment elements creates a unique mating pattern operable to cooperate with the latch key profile associated with a desired latch assembly to axially and circumferentially anchor and orient, for example, a whipstock assembly in a particular desired circumferential orientation relative to the latch coupling. The specific profile of each latch coupling can be created by varying one or more of the elements or parameters thereof. For example, the thickness, number and relative spacing of the recesses can be altered.

Latch coupling 200 includes four axially extending and circumferentially distributed slots 230. As illustrated, each of the slots is circumferentially aligned with one of the sets of recesses. For example, slot 232 is circumferentially aligned with primary recesses 224. As described in greater detail below, slot 232 is designed to operably engage the primary latch key placing the latch assembly in the proper circumferential orientation relative to latch coupling 200 such that no further rotation of the latch assembly will be require to operably engage of the latch keys with the latch profile. As described in greater detail below, slot 232 may be considered to be an orienting profile of an orienting subassembly integral with latch coupling 200. Alternatively, slot 232 may be considered to be a second portion of a two part orienting profile of an orienting subassembly, the first portion of which is integral with window joint 104, the second portion of which is integral with latch coupling 200. Even though latch coupling 200 has been depicted and described as having four slots 230, it should be understood by those skilled in the art that a latch coupling of the present invention could have a different number of slots including no slots in embodiments wherein the entire orienting subassembly is integral the window joint. Nonetheless, a latch coupling having at least one slot; namely, slot 232 is preferred.

Figure 5:
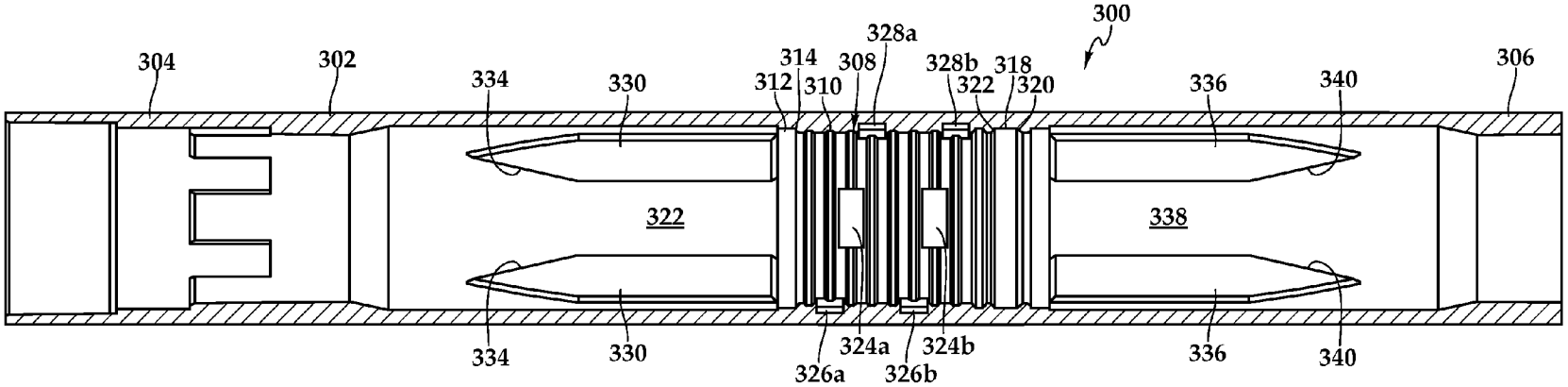
FIG. 5 is a cross sectional view of a latch coupling for use in a system for circumferentially orienting a downhole latch subsystem in a subterranean well according to an embodiment of the present invention.

Referring next to FIG. 5, another embodiment of a latch coupling for use in a system for circumferentially orienting a downhole latch subsystem of the present invention is depicted and generally designated 300. Latch coupling 300 has a generally tubular body 302 having an upper castellated coupling 304 and a lower connector 306. Latch coupling 300 includes an internal latch profile 308 including a plurality of axially spaced apart recessed grooves 310 that extend circumferentially about the inner surface of latch coupling 300. Latch profile 308 also includes an upper groove 312 having a lower square shoulder 314. Latch profile 308 further includes a lower groove 318 having a lower angled shoulder 320 and an upper angled shoulder 322.

Latch profile 308 has a plurality of circumferential alignment elements depicted as a plurality of recesses disposed within the inner surface of latch coupling 300. In the illustrated embodiment, there are four sets of two recesses that are disposed in different axial and circumferential positions and at 90 degree circumferential intervals from one another within the inner surface of latch coupling 300. For example, a first set of two recesses 324*a*, 324*b* (collectively recesses 324) are disposed within the inner surface of latch coupling 300 at substantially the same circumferential positions and different axial positions. Recesses 324 may be considered as the primary recesses as they are intended to receive the primary latch key. A second set of two recesses 326*a*, 326*b* (collectively recesses 326) are disposed within the inner surface of latch coupling 300 at substantially the same circumferential positions and different axial positions. A third set of two recesses 328*a*, 328*b* (collectively recesses 328) are disposed within the inner surface of latch coupling 300 at substantially the same circumferential positions and different axial positions. A fourth set of two recesses (not visible in FIG. 5) are also disposed within the inner surface of latch coupling 300 at substantially the same circumferential positions and different axial positions.

Latch coupling 300 includes a pair of axially extending rails 330 that protrude radially into latch coupling 300 forming a channel 332 therebetween. Each of the rails 330 has a tapered leading edge 334 that aids in operable engagement with the primary latch key. In the illustrated embodiment, channel 332 is circumferentially aligned with primary recesses 324. As described in greater detail below, channel 332 is designed to operably engage the primary latch key placing the latch assembly in the proper circumferential orientation relative to latch coupling 300 such that no further rotation of the latch assembly will be require to operably engage of the latch keys with the latch profile.

Figure 6:
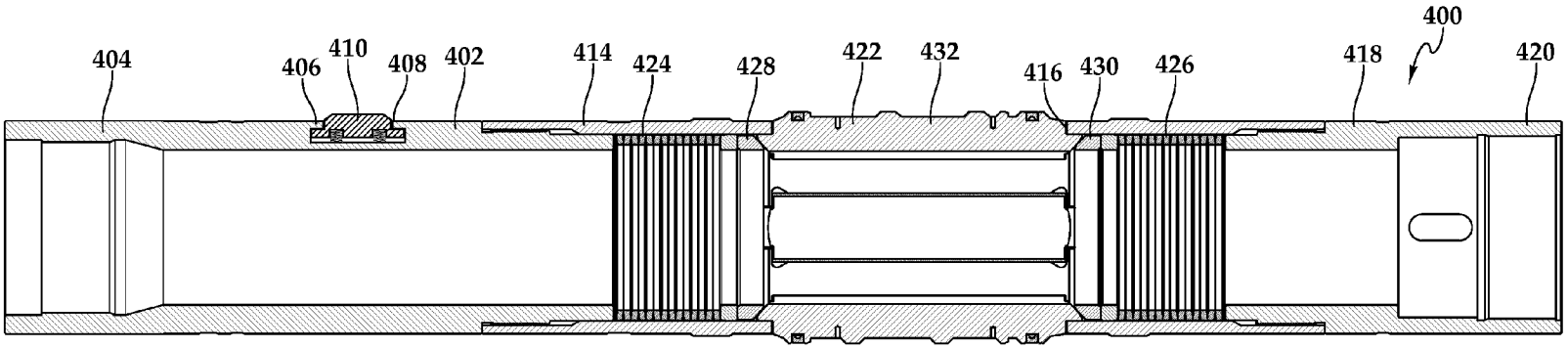
FIG. 6 is a cross sectional view of a latch assembly for use in a system for circumferentially orienting a downhole latch subsystem in a subterranean well according to an embodiment of the present invention.

Referring next to FIG. 6, one embodiment of a latch assembly for use in a system for circumferentially orienting a downhole latch subsystem of the present invention is depicted and generally designated 400. Latch assembly 400 has an outer housing 402 including an upper an upper connector 404 suitable for coupling latch assembly 400 to other tools or tubulars via a threaded connection, a pinned connection or the like. Outer housing 402 includes a retention key housing 406 having a retention key window 408. Disposed within retention key housing 406 is a spring operated retention key 410 that is operable to partially extend through retention key window 408. Downhole thereof, outer housing 402 includes a latch key housing 414 having four circumferentially distributed, axially extending latch key windows 416. Outer housing 402 also including a lower housing 418 having a lower connector 420 suitable for coupling latch assembly 400 to other tools or tubulars via a threaded connection, a pinned connection or the like. Disposed within key housing 414 are four spring operated latch keys 422 (only three of which are visible in FIG. 6) that are operable to partially extend through latch key windows 416. Latch keys 422 are radially outwardly biased by upper and lower Belleville springs 424, 426 that urge upper and lower conical wedges 428, 430 under latch keys 422.

Each of the latch keys 422 has a unique key profile that enables the anchoring and orienting functions of latch assembly 400 with a mating latch coupling having the appropriate latch profile. As illustrated, the key profiles includes a plurality of radial variations that must correspond with mating radial portions of a latch profile in order for latch keys 422 to operably engage with or snap into that latch profile. In order for each of the latch keys 432 to operably engage with a latch profile, the latch assembly 400 must be properly axially positioned within the mating latch coupling and properly circumferentially oriented within the mating latch coupling. For example, primary latch key 432 will mate with primary recesses 224, described above. In this manner, the axial location and circumferential orientation of a device, such as a deflection assembly, that is coupled to or operably associated with latch assembly 400 can be established. It is noted that primary latch key 432 is circumferentially aligned with retention key 410. As described in greater detail below, retention key 410 ensures that after operable engagement of primary latch key 432 with an orienting profile, primary latch key 432 remains circumferentially oriented with primary recesses 224 even after primary latch key 432 disengages from the orienting profile as the latch assembly is moved downwardly into axial alignment with the latch coupling.

The operation of a system for circumferentially orienting a downhole latch subsystem of the present invention will now be described. An outer tool string including a window joint, a latch coupling and a orienting subassembly, which may be integral with the window joint, the latch coupling or both, are interconnected in a casing string and the casing string is run into, for example, the main wellbore. Following completion, if desired, of any zones downhole of the window joint, an inner tool string including a deflection assembly, a latch assembly and a retention subassembly, if desired, is run into the casing string. Preferably, a retention key of the retention subassembly is circumferentially aligned with a specific and known latch key of the latch assembly such as the primary latch key of the latch assembly. The inner tool string is moved downhole via a conveyance such as a jointed tubing string until the latch assembly is on depth with the latch coupling. This operation is indicated by a weight signal on the surface. The inner tool string is then picked up a predetermined distance such that latch assembly is positioned in or uphole of the window joint. In this configuration, the inner tool string is rotated within the casing string to rotate the primary latch key of the latch assembly into coarse circumferential orientation within the window of the window sleeve. The coarse circumferential orientation can be achieved using a measurement while drilling (MWD) tool or based upon prior MWD or logging information.

When the primary latch key is circumferentially oriented within the window of the window sleeve, coarse circumferential orientation of the primary latch key is achieved and the inner tool string may be moved downhole. As this downhole movement occurs, the primary latch key will be guided by the window and the tapered section of the window sleeve until the primary latch key enters the first portion of the integrated orienting profile described herein as an axially extending slot of the window sleeve. In this configuration, the primary latch key may be considered as operably engaged with the orienting profile. Also, in this configuration, substantial circumferential orientation of the latch keys of the latch assembly with the latch profile has been achieved. As further downhole movement occurs, the retention key enters the orienting profile. The retention key may have a circumferential width greater than that of the primary latch key to further refine the circumferential orientation of the latch keys of the latch assembly with the latch profile. The primary latch key, the retention key or both may have tapered leading and trailing edges to aid in entry and passing through the orienting profile.

Further downhole movement of the inner tool string within the outer tools string causes the primary latch key to exit the first portion of the integrated orienting profile in the window joint and enter the second portion of the integrated orienting profile in the latch coupling, described above as a slot or channel operable to receive and guide the primary latch key. Preferably, the retention key remains in the first portion of the integrated orienting profile in the window joint until the primary latch key enters the second portion of the integrated orienting profile in the latch coupling to maintain the desired circumferential orientation. Further downhole movement of the inner tool string within the outer tools string may cause the retention key to exit the first portion of the integrated orienting profile in the window joint and enter the second portion of the integrated orienting profile in the latch coupling.

Continued downhole movement of the inner tool string within the outer tools string axially aligns the latch assembly with the latch coupling. Due to the above described circumferential orientation of the primary latch key with the orienting profile, the latch keys operably engage the latch profile with little or no rotation of the inner tool string. In this configuration, the latch keys axially and circumferentially anchor the latch assembly within the latch coupling. When the latch keys of the latch assembly have operably engaged the latch profile of the latch coupling, the deflection assembly is positioned in a desired circumferential orientation relative to the window joint such that a window can be milled, drilled or otherwise formed in the window joint in the desired axial position and circumferential direction.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. An apparatus for circumferentially orienting a downhole latch assembly in a wellbore, the latch assembly having a plurality of circumferentially distributed latch keys, one of which is a primary latch key, the apparatus comprising:

a casing string positionable in the wellbore;

a window joint interconnected in the casing string;

a latch coupling interconnected in the casing string downhole of the window joint, the latch coupling having a latch profile comprising a plurality of circumferentially distributed circumferential alignment elements corresponding to the plurality of circumferentially distributed latch keys; and an orienting subassembly interconnected in the casing string, the orienting subassembly having an orienting profile positioned uphole of the latch profile, the orienting profile comprising a plurality of axially extending and circumferentially distributed recesses each of which is circumferentially aligned with a respective one of the plurality of plurality of circumferentially distributed circumferential alignment elements, wherein, after operable engagement of the primary latch key with the orienting profile, axial alignment of the latch assembly with the latch coupling causes operable engagement of the latch keys with the latch profile to anchor the latch assembly in the latch coupling.

2. The apparatus as recited in claim 1 wherein the orienting subassembly is integral with the window joint.

3. The apparatus as recited in claim 1 wherein the orienting subassembly is integral with the latch coupling.

4. The apparatus as recited in claim 1 wherein a first portion of the orienting subassembly is integral with the window joint and a second portion of the orienting subassembly is integral with the latch coupling.

5. The apparatus as recited in claim 1 wherein the plurality of axially extending and circumferentially distributed recesses comprises an axial slot extending downhole from a window of the window joint.

6. The apparatus as recited in claim 1 wherein the plurality of axially extending and circumferentially distributed recesses comprises at least one axially extending slot in the latch coupling.

7. The apparatus as recited in claim 1 wherein the orienting subassembly further comprises at least two axially extending rails having a channel therebetween in the latch coupling, and wherein the channel defines one of the plurality of axially extending and circumferentially distributed recesses.

8. The apparatus as recited in claim 7 wherein each of the rails has a tapered leading edge.

9. The apparatus as recited in claim 1 wherein each of the plurality of axially extending and circumferentially distributed recesses includes a pair of generally straight sidewalls extending in an axial direction.

10. The apparatus as recited in claim 1 wherein each of the circumferentially distributed circumferential alignment elements of the latch profile only partially extend circumferentially about the of the latch coupling.

11. The apparatus as recited in claim 10 wherein each of the circumferentially distributed circumferential alignment elements of the latch profile comprises a plurality of recesses disposed at the same circumferential position and different axial positions.

12. A system for circumferentially orienting a downhole latch subsystem in a wellbore, the system comprising:

an outer tool assembly including a latch coupling having a latch profile and an orienting subassembly having an orienting profile positioned at least partially uphole of the latch profile, the latch profile comprising a plurality of circumferentially distributed circumferential alignment elements and the orienting profile comprising a plurality of axially extending and circumferentially distributed recesses each of which is circumferentially aligned with a respective one of the plurality of plurality of circumferentially distributed circumferential alignment elements; and an inner tool assembly positionable within the outer tool assembly including a latch assembly having a plurality of circumferentially distributed latch keys, one of which is a primary latch key, wherein, after operable engagement of the primary latch key with the orienting profile uphole of the latch coupling, axial alignment of the latch assembly with the latch coupling causes operable engagement of the primary latch key with at least one of the circumferential alignment elements of the latch profile to axially anchor the inner tool assembly within the outer tool assembly.

13. The system as recited in claim 12 wherein at least a portion of the orienting subassembly is positioned downhole of the latch profile.

14. The system as recited in claim 12 wherein the orienting subassembly is integral with the latch coupling.

15. The system as recited in claim 12 wherein the outer tool assembly further comprises a window joint and wherein the orienting subassembly is integral with the window joint.

16. The system as recited in claim 12 wherein the outer tool assembly further comprises a window joint, wherein a first portion of the orienting subassembly is integral with the window joint and wherein a second portion of the orienting subassembly is integral with the latch coupling.

17. The system as recited in claim 16 wherein the inner tool assembly further comprises a retention subassembly uphole of the latch coupling, the retention subassembly having at least one retention key that is circumferentially aligned with and axially spaced apart from the primary latch key and wherein, after operable engagement of the primary latch key with the first portion of the orienting profile, axial shifting of the latch assembly toward the latch coupling causes operable engagement of the retention key with the first portion of the orienting profile before disengagement of the primary latch key from the first portion of the orienting profile.

18. The system as recited in claim 12 wherein the inner tool assembly further comprises a retention subassembly uphole of the latch coupling, the retention subassembly having at least one retention key that is circumferentially aligned with and axially spaced apart from the primary latch key and wherein, after operable engagement of the primary latch key with the orienting profile, axial shifting of the latch assembly toward the latch coupling causes operable engagement of the retention key with the orienting profile before disengagement of the primary latch key from the orienting profile.

19. A method for circumferentially orienting a downhole latch subsystem in a wellbore, the method comprising:

positioning a casing string in the wellbore, the casing string including a latch coupling having a latch profile and an orienting subassembly having an orienting profile positioned uphole of the latch profile;

running a tool string into the casing string, the tool string including a latch assembly having a plurality of circumferentially distributed latch keys, one of which is a primary latch key;

positioning the latch assembly uphole of the orienting subassembly;

rotating the tool string to coarsely orient the primary latch key with the orienting profile;

moving the latch assembly downhole toward the latch coupling;

operably engaging the primary latch key with the orienting profile; and axially anchoring the latch assembly with the latch coupling by operably engaging the primary latch key with the latch profile.

20. The method as recited in claim 19 wherein operably engaging the primary latch key with the orienting profile further comprises operably engaging the primary latch key with an axial slot extending downhole from a window of a window joint interconnected in the casing string.

21. The method as recited in claim 19 wherein operably engaging the primary latch key with the orienting profile further comprises operably engaging the primary latch key with an axially extending slot of the latch coupling that is circumferentially aligned with a circumferential alignment element of the latch profile.

22. The method as recited in claim 19 wherein operably engaging the primary latch key with the orienting profile further comprises operably engaging the primary latch key with an axially extending channel of the latch coupling.

23. The method as recited in claim 19 further comprising operably engaging a retention key of a retention subassembly of the tool string that is circumferentially aligned with and axially spaced apart from the primary latch key with the orienting profile after operably engaging the primary latch key with the orienting profile and before disengaging the primary latch key from the orienting profile.

24. The method as recited in claim 19 wherein rotating the tool string to coarsely orient the primary latch key further comprises orienting the primary latch key based upon at least one measured property of the wellbore.

* * * * *